US005819423A

United States Patent [19]

Kamola

[11] Patent Number: 5,819,423

[45] Date of Patent: Oct. 13, 1998

[54] STRING MOUNTED REAR BOW SIGHT

[76] Inventor: Roman C. Kamola, 1752 Shay Rd., Naples, N.Y. 14512

[21] Appl. No.: 877,485

[22] Filed: Jun. 17, 1997

[51] Int. Cl.[6] ..... F41G 1/467

[52] U.S. Cl. ..... 33/265; 124/90

[58] Field of Search ..... 33/265; 124/87, 124/90, 91

[56] References Cited

U.S. PATENT DOCUMENTS

| | | | |
|---|---|---|---|
| D. 344,123 | 2/1994 | Bertram | 33/265 |
| 3,847,133 | 11/1974 | Awiszus | 124/91 |
| 3,866,502 | 2/1975 | Carella | 33/265 |
| 4,563,821 | 1/1986 | Saunders | 33/265 |
| 4,656,747 | 4/1987 | Troncoso | 124/87 |
| 4,961,264 | 10/1990 | Topel | 33/265 |
| 4,965,938 | 10/1990 | Saunders | 33/265 |
| 5,107,596 | 4/1992 | Snyder | 124/90 |
| 5,157,839 | 10/1992 | Beutler | 33/265 |

FOREIGN PATENT DOCUMENTS

| | | | |
|---|---|---|---|
| 1239593 | 10/1959 | France | 33/265 |

*Primary Examiner*—G. Bradley Bennett
*Attorney, Agent, or Firm*—Robert J. Bird

[57] ABSTRACT

A string mounted rear bow sight includes a body with a bowstring hole, and a bifurcated rod extending forward from the body to straddle the bowstring and enclose it within the bowstring hole. A fluoresent material is mounted on the body to absorb ultraviolet light and emit a brilliant fluorescent light. An elastic sight orienting tube is connected to the bow and to the bifurcated rod to orient the rear sight toward a front sight on the bow, and to pull the rear sight upward on the bowstring against a preestablished fixed point thereon when the bowstring is drawn.

3 Claims, 4 Drawing Sheets

STRING MOUNTED REAR BOW SIGHT

FIELD OF THE INVENTION

This invention is a string mounted rear sight for a bow, such as a compound bow or a long bow.

BACKGROUND OF THE INVENTION

Various string mounted rear bow sights are commercially available. Those that I know of are peep sights. Many of these are mounted by severing the bowstring and splicing the sight into the string by tying the string above and below the sight. These spliced peep sights have a tendency to move over time, with resulting loss of sighting accuracy.

Existing rear peep sights have another inherent disadvantage or limitation. The archer is looking through a small aperture or peep hole, and the very size of that peep hole limits the archer's field of view. At close range, this makes it difficult if not impossible for the archer to see the full profile of a large game animal, such as a deer, and thus to pick the desired point of aim on the animal's body. One approach to this problem has been to increase the size of the peep hole. This is not a satisfactory solution, however. A larger peep hole enlarges the field of view, but at the expense of sighting accuracy.

SUMMARY OF THE INVENTION

A string mounted rear bow sight according to this invention includes a body with a vertical bowstring hole, and a bifurcated rod extending forward from the body to straddle the bowstring and enclose it within the bowstring hole. A fluoresent material, mounted on the body to absorb ultraviolet light and emit a brilliant fluorescent light, has a small area thereof visible to an archer when the bow is held in operating position. An elastic sight orienting tube is connected to the bow and to the bifurcated rod to orient the rear sight toward a front sight on the bow, and to pull the rear sight upward on the bowstring against a preestablished fixed point thereon when the bowstring is drawn.

DRAWING

Figure 3:
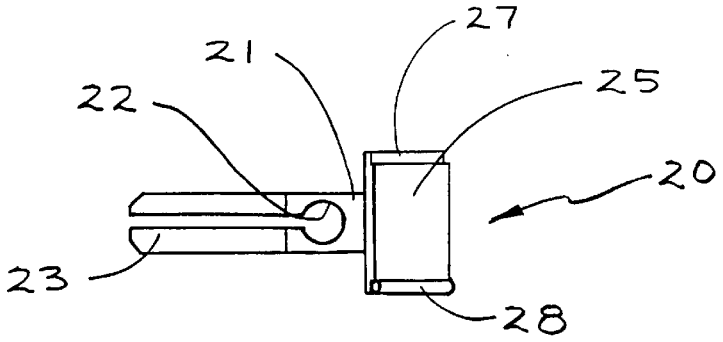
Figure 4:
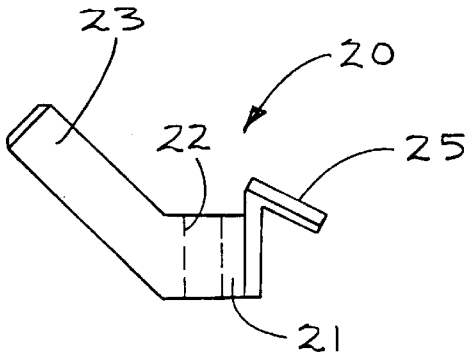
Figure 5:
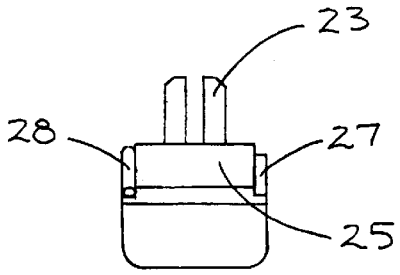

FIGS. 3, 4, and 5 are top, side, and rear views respectively of a bow sight according to this invention.

Figure 2:
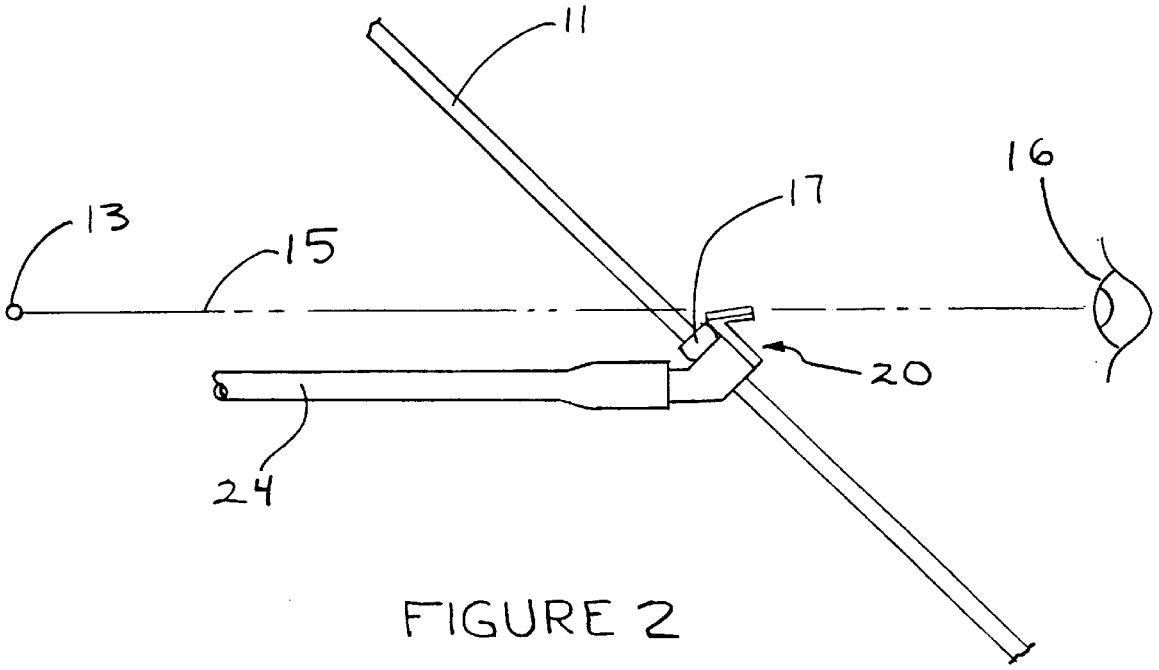
FIG. 2 is an enlarged detail from FIG. 1, showing my bow sight mounted on a bow string.
Figure 6:
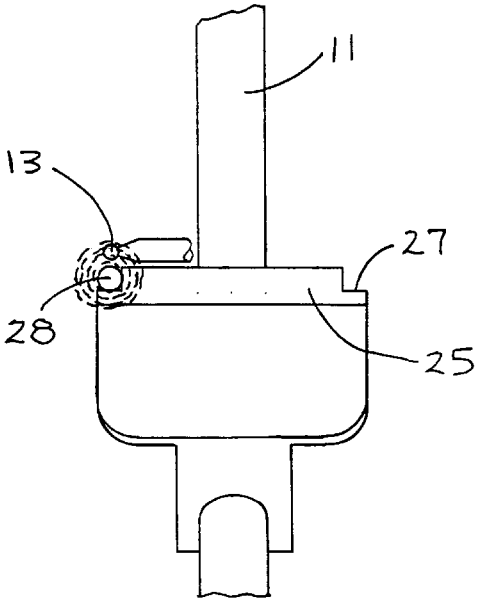
Figure 7:
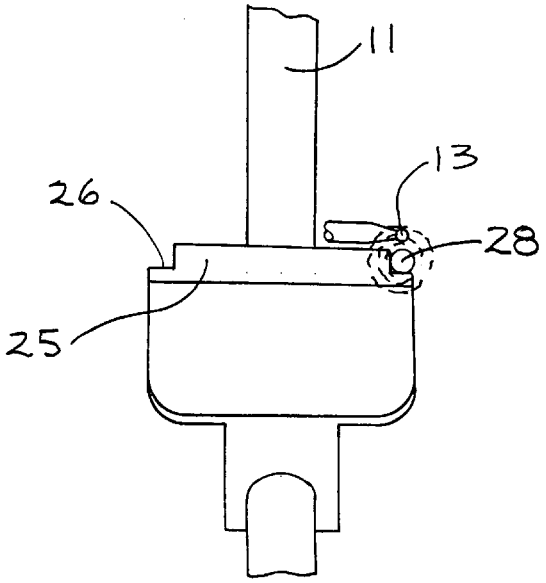

FIGS. 6 and 7 are enlarged rear views of the bow sight from FIG. 2, for right and left handed archers respectively.

Figure 8:
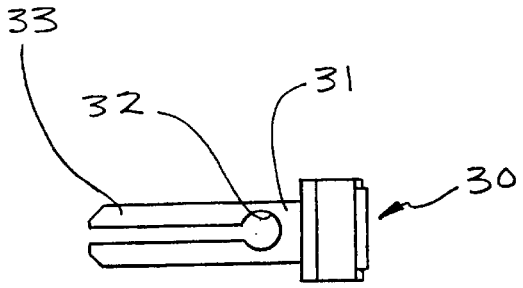
Figure 9:
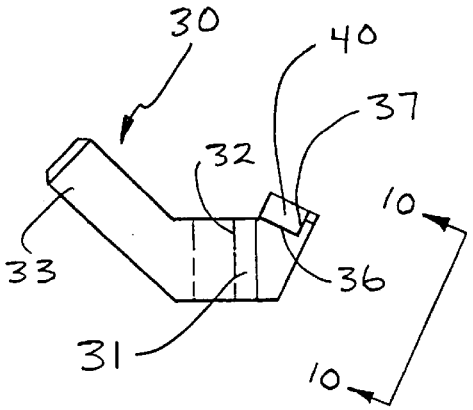
Figure 10:
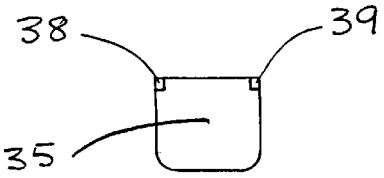

FIGS. 8, 9, and 10 are top, side, and rear views of another embodiment of my bow sight.

Figure 11:
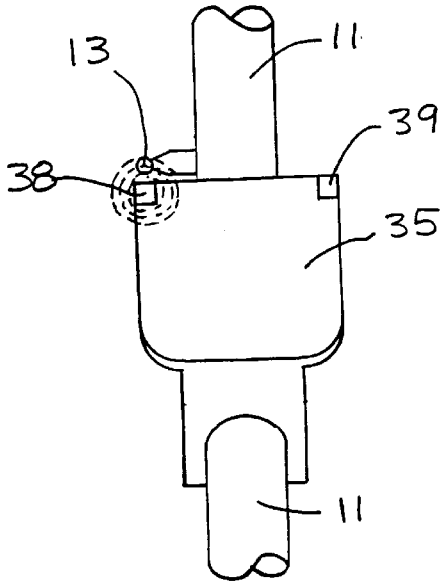

FIG. 11 is an enlarged rear view of the right handed version of the bow sight of FIGS. 8, 9, 10.

DESCRIPTION

Figure 1:
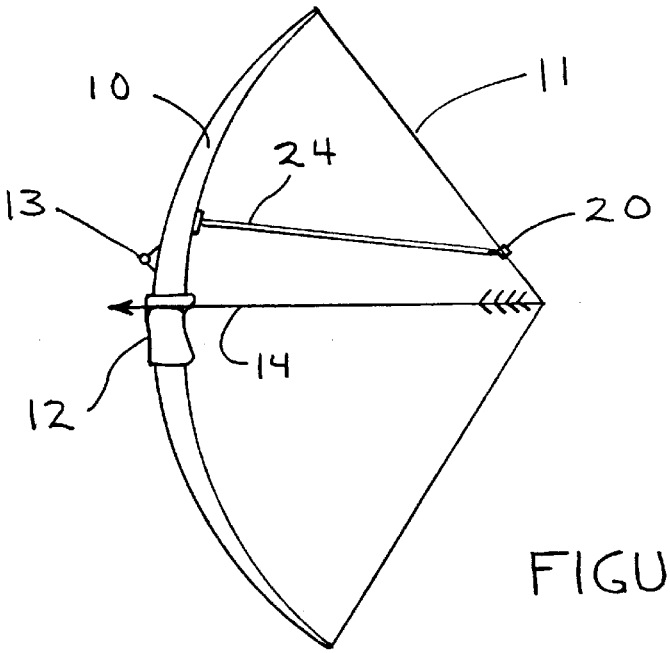
FIG. 1 is a simplified representation of a bow.

FIG. 1 shows a bow 10 with a bowstring 11, grip 12, a front sight 13 on the bow, and an arrow 14. The string 11 and arrow 14 are drawn and ready for release. FIG. 2 shows my rear bow sight 20 mounted on the upper part of the bowstring 11, on an optical axis 15 between the front sight 13 and the eye 16 of an archer. The position of the rear sight 20 on the bowstring 11 is set by a nok set 17.

FIGS. 3, 4, and 5 are top, side, and rear views of the rear bow sight 20. The sight 20 includes a central body 21 with a vertical bowstring hole 22 through it, a bifurcated rod 23 extending forward from the body 21, and a sight table 25 upraised from the body 21. The bifurcated rod 23 straddles the bowstring 11 to position the bowstring 11 into the bowstring hole 22, The bifurcated rod 23 is resilient to allow its two branches to spread apart enough to snap the bowstring into the bowstring hole 22. The sight 20 slides freely on the bowstring 11. An elastic sight orienting tube 24 extends from the bow 10 to the sight 20, fitting over the rod 23. The sight is preferably of black matte plastic.

In FIG. 5 the sight table 25, shown in an oblique view, is a flat table with shelves 26, 27 on its left and right sides, respectively. A fluorescent rod 28 is fixed in place along the left shelf 26. The rod 28 is approximately 0.040 inches in diameter and 0.250 inches long. It is an acrylic material containing a suitable fluorescent pigment which absorbs ultraviolet light along its length and emits a brilliant flourescent colored light at each end.

FIGS. 6 and 7 are enlarged rear views of the bow sight from FIG. 5, showing the sight table 25 with its top surface horizontal, as it will be in use. FIG. 6 shows a right handed version of the bow sight, with a fluorescent rod 28 in the left shelf 26. FIG. 7 shows a left handed version of the bow sight, with a fluorescent rod 28 in the right shelf 27.

In operation, as the archer pulls back on the bowstring, the sight orienting tube 24 pulls the sight 20 upward on the bowstring until it abuts the string nok 17, and also orients the sight 20 so that the end of the rod 28 is on the optical axis 15 and directed toward the front sight 13. The sight 20 is now about four inches from the archer's eye. The archer is looking at and focused on the target. He also sees a circular glow or halo of fluorescent light emanating from the end of the fluorescent rod 28. A right handed archer will see a view as represented by FIG. 6. A left handed archer will see a view as represented by FIG. 7. The archer moves the bow until the front sight is positioned in the glow circle, thereby establishing a line of sight to the target.

FIGS. 8, 9, and 10 are top, side, and rear views of another embodiment of my bow sight. The sight 30 includes a central body 31 with a vertical bowstring hole 32 through it, a bifurcated rod 33 extending forward from the body 31, and a sight table 35 upraised from the body 31.

FIG. 10 is a rear view from the direction indicated by arrows 10—10 in FIG. 9. The sight table 35 includes a table surface 36 with a rear wall 37 which extends partially across the width of the table surface. The wall 37 has notches 38, 39 on its upper left and right corners, respectively. A fluorescent block 40 fits on the table surface 36 against the wall 37. The block 40, like the rod 28, is an acrylic material containing a fluorescent pigment which absorbs ultraviolet light along its exposed upper surface and emits visible a brilliant fluorescent colored light at each end.

FIG. 11 is an enlarged rear view of the bow sight 30 as seen in FIG. 10. This is the view seen by the archer. The rear wall 37 of the sight table 35 obscures all of the fluorescent block 40 except for the small areas exposed by the upper left and right notches 38, 39 of the rear wall 37. Operation of the sight 30 is the same as that of the sight 20 described earlier.

Only the end of the rod 28 is visible to the archer. Likewise, only the small areas of block 40 exposed by notches 38, 39 are visible to the archer. These are the light sources seen by the archer. It is desirable that they be like "point sources" of glow or halo. It is also desirable that the glow be bright enough to be effective. To maximize the glow, the greater portions of the fluoresent members (rod 28, block 40) are exposed to absorb ultraviolet light.

This invention is not limited to use with fluorescent light sources. A battery powered light might be used if the bulb and battery unit can be made small, light, and strong enough to withstand the forces exerted on it by the bowstring upon its release. The bulb would be positioned in the upper corners of the sight body and produce the desired circular glow or halo. Such an arrangement would have the advantage of not being dependent on ambient light.

In all cases, the sight orienting tube 24 not only orients the sight about the bowstring and toward the target, but it also pulls the sight up against the fixed nok set, thus providing a consistent anchor point for repeatable sight accuracy. A second nok set below the sight, to prevent the sight from moving far from the upper nok set when the bow is undrawn, is optional.

Unlike a peep hole sight, the sight of this invention does not circumscribe, or interfere with, or limit, the archer's field of view.

The foregoing description of a preferred embodiment of this invention, including any dimensions, angles, or proportions, is intended as illustrative. The concept and scope of the invention are limited only by the following claims and equivalents thereof.

What is claimed is:

1. A rear sight for a bow having a front sight thereon and a bowstring operatively connected thereto, said rear sight including:

a body including a vertical bowstring hole;

a bifurcated rod extending forward from said body to straddle said bowstring to position said bowstring slidably within said bowstring hole;

a fluoresent material mounted on said body to absorb ultraviolet light and emit fluorescent light, said fluorescent material including a minor area thereof visible to an archer when said bow is held in operating position; and an elastic sight orienting tube for connection to said bow and to said bifurcated rod, said orienting tube effective when said bow is drawn to orient said rear sight toward said front sight and to pull said rear sight upward on said bowstring against a preestablished fixed point thereon.

2. A rear sight for a bow having a front sight thereon and a bowstring operatively connected thereto, said rear sight including:

a central body including a vertical bowstring hole;

a bifurcated rod extending forward from said body to straddle said bowstring to position said bowstring slidably within said bowstring hole;

a fluoresent rod mounted on said body to absorb ultraviolet light and emit fluorescent light, said rod including an end directed at an archer when said bow is held in operating position; and an elastic sight orienting tube for connection to said bow and to said bifurcated rod, said orienting tube effective when said bow is drawn to orient said rear sight toward said front sight and to pull said rear sight upward on said bowstring against a preestablished fixed point thereon.

3. A rear sight for a bow having a front sight thereon and a bowstring operatively connected thereto, said rear sight including:

a central body including a vertical bowstring hole;

a bifurcated rod extending forward from said body to straddle said bowstring to position said bowstring slidably within said bowstring hole;

a fluoresent block mounted on said body to absorb ultraviolet light and emit fluorescent light, said block including a face directed at an archer when said bow is held in operating position;

a mask to limit the area of said face visible to said archer; and an elastic sight orienting tube for connection to said bow and to said bifurcated rod, said orienting tube effective when said bow is drawn to orient said rear sight toward said front sight and to pull said rear sight upward on said bowstring against a preestablished fixed point thereon.

* * * * *